United States Patent [19]

Guillermin et al.

[11] 4,016,626

[45] Apr. 12, 1977

[54] APPARATUS FOR SIMULTANEOUSLY TEXTURIZING AND CUTTING CONTINUOUS YARNS

[75] Inventors: René Guillermin, Bron; Jean Joly, Craponne; Sylvio Sangalli, Caluire, all of France

[73] Assignee: Rhone-Poulenc-Textile, Paris, France

[22] Filed: Jan. 20, 1976

[21] Appl. No.: 650,796

Related U.S. Application Data

[62] Division of Ser. No. 583,913, June 5, 1975.

[30] Foreign Application Priority Data

June 10, 1974 France ..... 74.20252

[52] U.S. Cl. ..... 19/.46; 28/1.3; 28/1.4; 28/1.6

[51] Int. Cl.[2] ..... D01G 1/00; D02G 1/20; D02G 1/16; D02G 1/12

[58] Field of Search ..... 28/1.2, 1.3, 1.4, 1.6, 28/72.1, 72.11, 72.12, 72.14; 19/.3, .32, .46, .6; 57/140 R

[56] References Cited

UNITED STATES PATENTS

| | | | |
|---|---|---|---|
| 2,908,944 | 10/1959 | Benninga et al. | 19/.46 X |
| 3,217,482 | 11/1965 | Baer | 28/1.3 X |
| 3,530,751 | 9/1970 | Munroe | 19/.32 X |

FOREIGN PATENTS OR APPLICATIONS

| | | | |
|---|---|---|---|
| 286,128 | 12/1971 | U.S.S.R. | 28/1.2 |
| 1,085,057 | 9/1967 | United Kingdom | 28/1.2 |

*Primary Examiner*—Louis K. Rimrodt
*Attorney, Agent, or Firm*—Sherman & Shalloway

[57] ABSTRACT

An apparatus for processing yarn in order to texturize and cut the yarn includes means for using a fluid to direct yarn into a tube which has a rotating spindle therein around which the yarn forms a wad. At least part of the fluid is exhausted from the tube and the wad is then cut and removed from the spindle.

5 Claims, 1 Drawing Figure

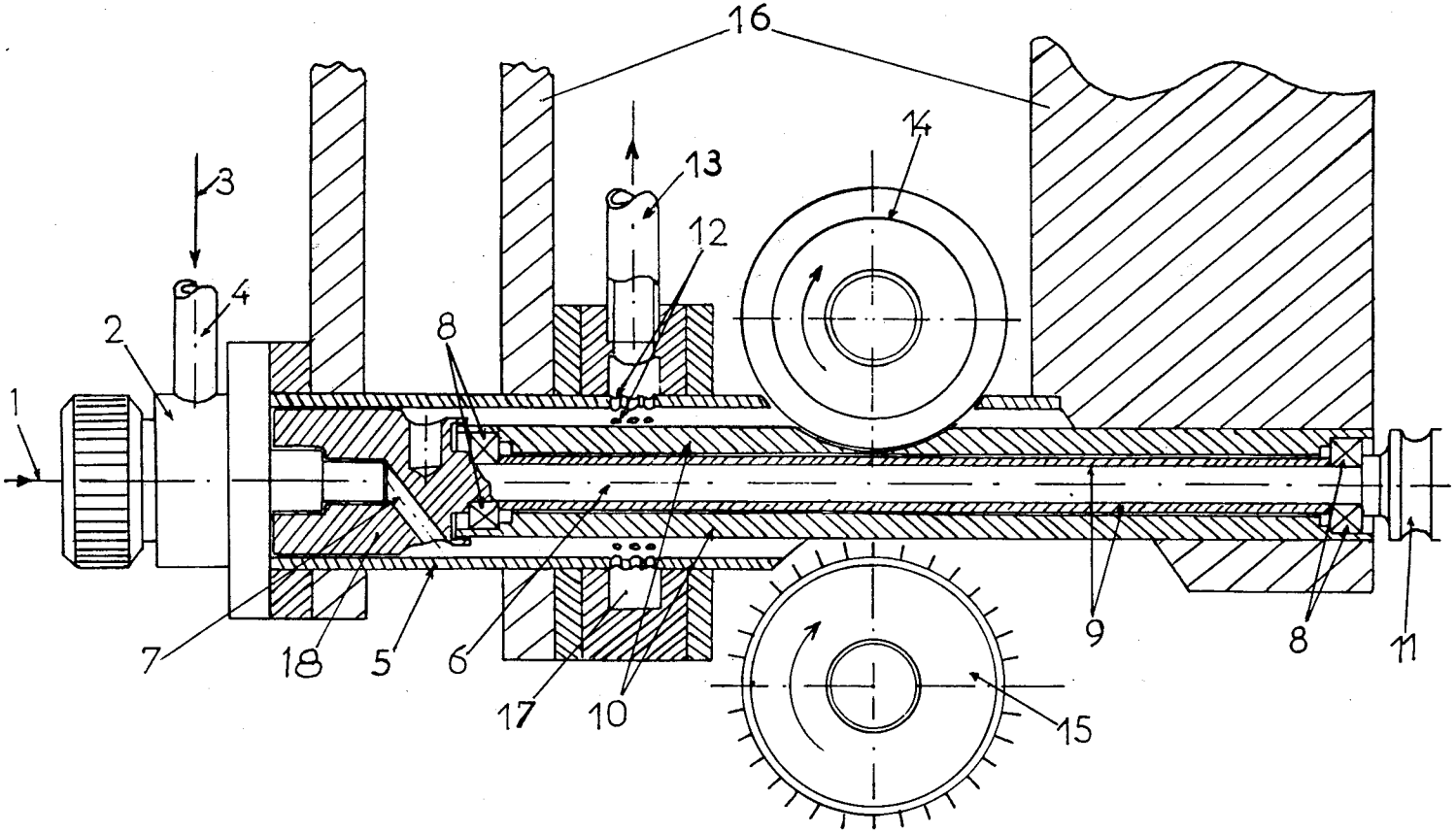
11
8
9
15
14
16
13
12
10
17
6
8
5
18
3
4
7
2
1

APPARATUS FOR SIMULTANEOUSLY TEXTURIZING AND CUTTING CONTINUOUS YARNS

This is a division of application Ser. No. 583,913, filed June 5, 1975.

BACKGROUND OF THE INVENTION

1. Field of the Invention

The present invention relates to an apparatus for continuously crimping and cutting at least one continuous yarn.

2. Technical Consideration and Prior Art

When it is desired to process synthetic or artificial textile fibers, in the form of a mixture with natural fibers, it is necessary, since the latter fibers are crimped, to crimp the synthetic fibers, in order to improve the homogeneity of the mixture prior to converting it, generally to a yarn spun from fibers.

The crimping operation is carried out in a known manner on continuous filaments in the form of a tow. The cutting operation follows the crimping operation. Either a stuffing-box or two cogwheels, between which the tow passes, is generally used to effect the crimping operation. The crimping obtained is uniform, and the fibers are crimped in phase. However, it is often preferable to have fibers, in which the crimps are not in phase and are disordered.

The disordered crimping of filaments is preferably achieved by means of pneumatic processes such as those described, for example, in U.S. Pat. Nos. 3,373,470, 3,703,754 and 3,827,113 assigned to the company to which the instant invention is assigned.

According to these processes, at least one multi-filament yarn is introduced into an injecting device simultaneously with passing a hot fluid under pressure into the injecting device. Under the effect of this fluid, the filaments of the yarn become separated. The turbulence creates a phase displacement between the filaments, which are no longer parallel to one another. Further, under the effect of the fluid, the filaments are subsequently introduced into one end of a large tube of constant cross-section, which is open to the atmosphere at its other end, and is perforated laterally with orifices, through which a part of the fluid escapes. The remainder of the fluid pushes the filaments, which become stacked up inside the tube to form a piled-up wad.

It was possible to derive benefit from this piled-up wad, and to cut it and thereafter to collect the fibers obtained. This was the subject of U.S. Pat. application Ser. No. 436,911, assigned to the assignee of the instant invention, according to which, it is proposed to cut the wad, either at the outlet of the crimping tube or inside the crimping tube.

It has already been proposed, particularly in U.S. Pat. No. 1,983,326, to cut yarns continuously, while they are being wound up on a mandrel. In this patent, the yarns are wound around a heated mandrel, and are then cut from inside the mandrel by means of reciprocating knives, which cut the yarns that have been wound up. The hot mandrel makes it possible to fix the coiled shape of the yarns, and after cutting, to obtain loop fibers. However, this device is complicated, and the fibers obtained have uniform loops.

The present invention also provides apparatus for continuously texturizing and cutting at least one continuous yarn. The apparatus includes a spindle rotatable about its axis, a tube substantially coaxial with said spindle and surrounding the latter, lateral orifices formed in the tube, means for rotating the spindle about its axis, and means for introducing yarn under the action of a fluid into the space between the spindle and the coaxial tube. The yarn is wound around the spindle, and the fluid at least partly escapes through the lateral orifices forming a piled-up wad of filamentary material. Means are provided for cutting the wad of piled-up yarn within the tube, and means are provided for removing the cut yarn.

BRIEF DESCRIPTION OF THE DRAWING

The FIGURE is a cross-section through one embodiment of an apparatus according to the invention.

DETAILED DESCRIPTION

The apparatus shown in the FIGURE includes an injecting device 2 with an orifice for introducing a yarn 1 and a pipe 4 for introducing a fluid 3. A cylindrical tube 5 of constant cross-section is connected to the injecting device, and is held in position by a frame 16. Formed in the tube 5 are lateral orifices 12, through which a part of the fluid escapes into a chamber 17 surrounding the tube. The fluid also escapes to an outside zone through a pipe 13. The escape of the fluid to the outside zone is either free or is controlled, so as to maintain a back-pressure in the chamber 17. Inside the tube 5, there is a revolving spindle 6, which is mounted in a fixed sleeve 10. Cross-bars 9 connect two roller bearings 8 and revolve with the latter. The spindle is rotated by a belt trained around a pulley 11 fixed to its end. The belt and the motor effect rotation which is not shown in the FIGURE.

The revolving spindle 6 consists of two parts. One part 18 has a diameter substantially the same as the internal diameter of the tube 5, and is situated inside the latter near the injecting device. The part 18 is provided with an internal feed-tube 7, through which the yarn passes. The other part of the spindle 6 is straight, long and narrow and rests on the bearings 8. A space is maintained between the fixed sleeve 10 of the spindle and the wall of the tube 5, in order to make it possible for the yarn to be wound up, to move forward and to pile up in the region of the orifices 12.

At the downstream end of the tube 5, a cutting component 14 is mounted. The cutting component 14 consists of a rotating blade (rotated by a means not shown). The lower part of the blade enters the tube through slits in the tube 5 and the sleeve 10. A stripping device 15 clears away the cut fibers, which are then sucked up by a device, such as a vacuum collector (not shown).

In operation, the yarn 1 is introduced into the injecting device 2, and is subjected to the action of the hot fluid 3, fed in through the pipe 4. Under the influence of the fluid, the filaments of the yarn become separated and rumpled. The filaments also pass into the feed tube 7 of the part 18 of the revolving spindle 6, which is rotated by means of a belt (not shown). A piled-up wad first forms in the region of the orifices 12, and is wound around the sleeve 10 of the spindle 6. The wad is then subjected to the action of the cutting blade 14, and the stripping device 15 collects the fibers obtained, which are sucked into a box (not shown).

The device, according to the invention, thus makes it possible to obtain fibers possessing disordered crimps, and being of non-uniform cut, the fibers therefore have a cutting diagram similar to that of wool. The depth of the cut can be adjusted, and it is possible, if so desired, to place several cutting components on the same apparatus. In addition, it is possible to provide for the introduction, into the space between the sleeve of the spindle and the tube, of a gas or a liquid (for example, dyestuffs, size, antistatic agents and the like). It is also possible to provide lateral perforations on the part 18 of the revolving spindle situated near the injecting device, through which a portion of the fluid can escape. Furthermore, the spindle can be heated internally, and can be controlled either from the outside or from the inside. Other means may be provided for either heating the product or cooling the product over the entire length of the apparatus. This apparatus makes it possible to cut the piled-up wad completely or partially. When cut partially, the stripping device is not utilized nor is the part of the frame near the righthand end of the spindle, which is then rotated by other means, in order to make it possible for the product to be removed.

If desired, it is possible either to collect the partially cut piled-up wad, in order to twist it subsequently so as to obtain a product of the type of a yarn spun from fibers, or to twist the partially cut piled-up wad continuously as it is being cut, in order to complete the twist imparted inside the apparatus by the spindle.

The crimping/cutting apparatus of the present invention may or may not be positioned after a yarn production apparatus. Preferably, it can be integrated into yarn production, because benefit is derived from slowing down the yarn in the tube, in spite of the high speed (which can be, for example, as much as 2,500 meters/minute) at which the yarn is supplied to the injecting device.

Several yarns can be introduced simultaneously into the apparatus, and it is also possible to introduce a monofilament together with a plasticizing fluid, and to provide a means for heating the revolving spindle, so that cut loop yarns are then obtained. The revolving disc can be provided with its own sharpening means.

An apparatus, with universal applications, is thus provided, which makes it possible to effect crimping or non-crimping, twisting, and complete or partial cutting. All these processes may be performed optionally, while effecting simultaneous dyeing. This apparatus is of small overall size, and is very reliable. It may be positioned immediately after the yarn manufacturing equipment and optionally employing suitable means, when working continuously, it may be positioned in front of an operation for weaving or knitting.

EXAMPLE

A multi-filament continuous yarn made of polyamide 2300 dtex/136 filaments is supplied to the injecting device at 1,000 meters/minute, and is treated by means of the apparatus shown in the FIGURE according to the following parameters:

Pressure of steam supplied to the injecting device: . . . 8 kg/cm$^2$

Back-pressure maintained in the chamber 17 . . . 3 kg/cm$^2$

Internal diameter of the tube 5 . . . 30 mm

External diameter of the sleeve 10 of the spindle . . . 22 mm

The piled-up wad is cut by means of the disc revolving at 800 revolutions/minute; the coiled wad moves forward at 15 meters/minute onto the spindle revolving at 7,000 revolutions/minute, and the rate of rotation of the stripping device is 17 meters/minute.

By using the apparatus of the instant invention with these parameters, the length of the fibers obtained is between 65 and 90 mm, and the fibers have disordered crimps.

In as much as the present invention is subject to many variations, modifications and changes in detail, it is intended that all matter described above or shown in the accompanying drawing be interpreted as illustrative, and not in a limiting sense. The invention is limited only by the appended following claims.

What is claimed is:

1. Apparatus for continuously texturizing and cutting at least one multifiliment continuous yarn, wherein the yarn is texturized by fluid pressure, said apparatus comprising:

an injecting device which includes at least one orifice for feeding said multifiliment yarn into the apparatus and one orifice for introducing a texturizing fluid;

a cylindrical tube connected to the injecting device wherein the cylindrical tube has a constant cross-section and includes lateral orifices for exhausting the fluid and is connected at one end with the injecting device;

a revolving spindle positioned in the cylindrical tube wherein the revolving spindle includes a rotating part adjacent the injection device wherein the rotating part is provided with an internal feed tube through which passes the multifiliment yarn and a fixed sleeve around which the yarn is wound to form a stuffed pack of yarn between the fixed sleeve and cylindrical tube;

at least one cutting means for cutting the pack of yarn wound on the sleeve into a plurality of staple fibers, and means for stripping the staple fibers from the sleeve.

2. Apparatus according to claim 1, wherein the spindle includes a first part having a slightly smaller diameter than the tube, and wherein the spindle includes a second part wider in diameter than the first part and positioned adjacent to the tube, said wider diameter part having a feed tube therein for introducing the yarn, said feed tube opening into a space between the spindle and the tube.

3. Apparatus according to claim 1, wherein the cutting means comprises a blade rotatable within a slot in the tube.

4. Apparatus according to claim 1, wherein at least a part of the spindle is mounted within the sleeve carried within the tube, and wherein the sleeve carries bearings for mounting the spindle.

5. Apparatus according to claim 1, wherein the means for removing the yarn comprise a rotatable wheel mounted in a space adjacent the end of the tube, and wherein the spindle extends beyond the end of the tube.

* * * * *